United States Patent [19]

Perron et al.

[11] 3,979,647

[45] Sept. 7, 1976

[54] INDUCTIVELY COUPLED LOCK

[75] Inventors: Robert Richard Perron, Beverly; John Thomas Fowler, Winchester, both of Mass.

[73] Assignee: The Eastern Company, Naugatuck, Conn.

[22] Filed: June 11, 1975

[21] Appl. No.: 586,019

[52] U.S. Cl. ..... 317/134; 318/162; 340/274 C; 70/277

[51] Int. Cl.[2] ..... E05B 47/06

[58] Field of Search ..... 317/134; 318/162; 340/274 C; 70/277

[56] References Cited

UNITED STATES PATENTS 3,344,629 10/1967 Burney ..... 340/274 C 3,353,383 11/1967 Fish ..... 340/274 C

*Primary Examiner*—R. N. Envall, Jr.

*Attorney, Agent, or Firm*—Stefan M. Stein

[57] ABSTRACT

An inductively coupled electronic lock system wherein the key has a clock driven variable pulse width generator with alterable pulse sequence input to an inductor. The lock part of the system has an inductive pick-up which discriminates against all but a preselected sequence of pulses, converts the received signals to DC and powers a motor to open the lock.

3 Claims, 5 Drawing Figures

FIG. 1
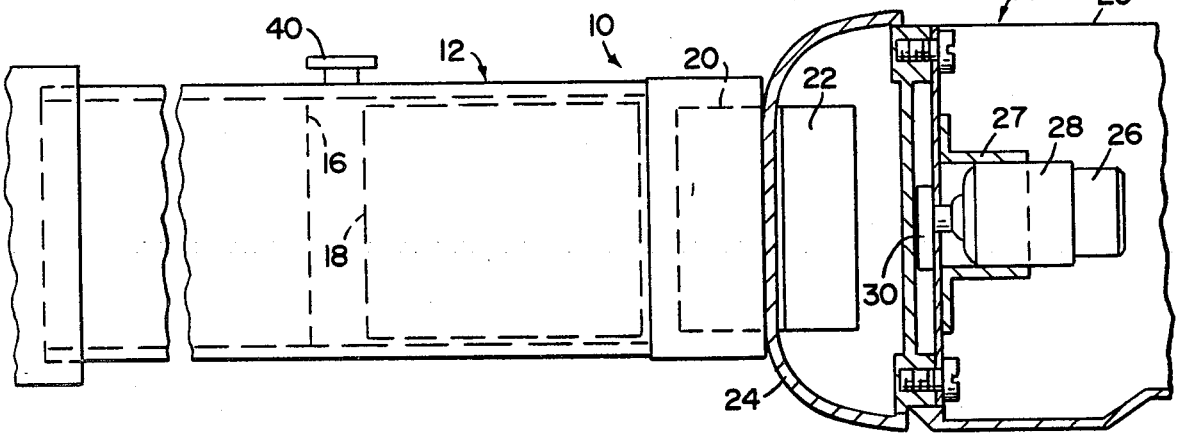
FIG. 2
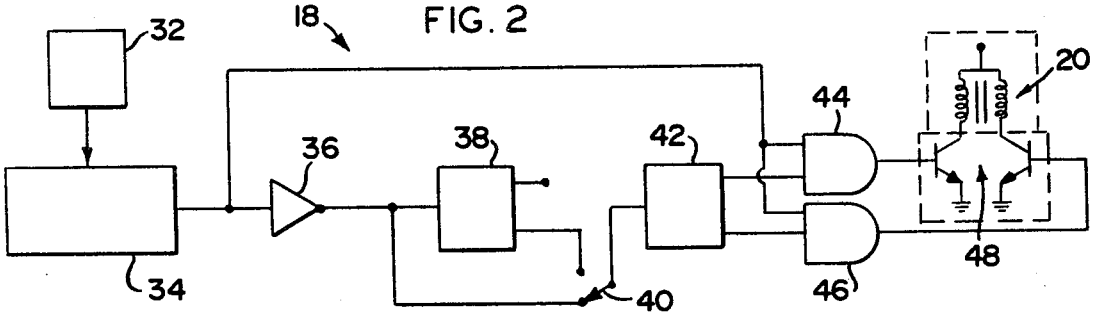
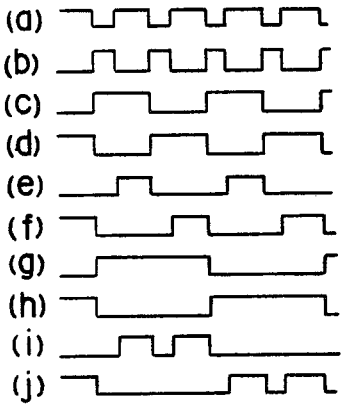
FIG. 3
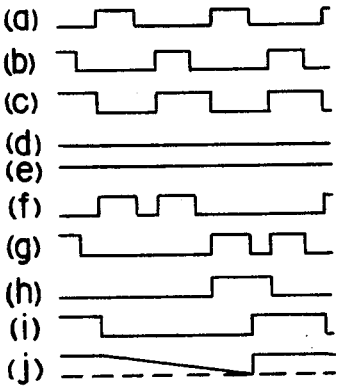
FIG. 5
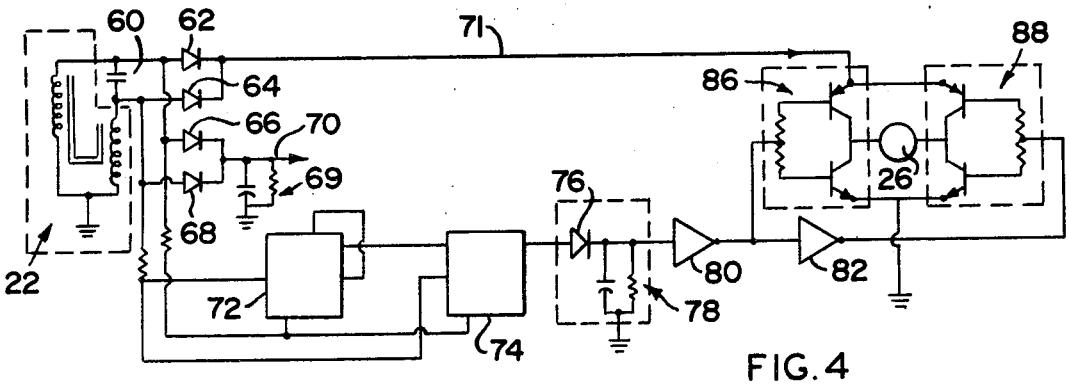
FIG. 4

INDUCTIVELY COUPLED LOCK

BACKGROUND OF THE INVENTION

1. Field of the Invention

An inductively coupled lock with a key providing pulse sequences to the lock which respond to a specific pulse sequence and derives power to open the lock from the key.

2. Description of the Prior Art

Electronic lock systems are well known in the prior art. These take various forms. Generally, the key or a coded device is placed within an aperture in the lock portion of the system. The lock is designed to then discriminate against all but a predetermined code. In the specific case of electronic locks, the key is encoded in any number of ways. Some prior art encoding techniques include the provision of punched holes which correspond to electrical probes within the lock. Conductive strips are also utilized, which complete the electrical circuit with the lock. Other methods include an electromagnetic code on the key which is discerned by cooperating circuitry within the lock.

One type of electronic lock system known in the prior art has a key comprising a coil or ferite rod and the lock has a corresponding coil. When the key is placed in close proximity to the lock a resident circuit within the lock itself is completed causing the lock to open.

These systems are complex and can be costly to construct and maintain. The advantages of electronic locks are many and well known. However, there are certain disadvantages in the presently known electronic lock systems.

First, the electronic lock requires a source of electricity. A number of prior art locks have the power source within the lock portion of the system. This is frequently inconvenient and impractical for certain applications where the lock itself is inaccessable to a power source.

Many presently known electronic lock systems are generally designed to have a large number of replaceable or recodeable keys capable of fitting a relatively small number of locks. These locks have the sophisticated mechanisms contained within them along with a power source. This is inconvenient and impractical in cases where one key can fit many locks and the locks themselves are subject to severe abuse and located in places inaccessable to a power supply.

Another problem commonly associated with electronic systems is that the receiving aperture in the lock for the key is subject to tampering. The insertion of foreign material into the receiving aperture of a sohpisticated electronic lock could severely damage or destroy many conventional electronic locks by fouling contact or destroying electromagnetic sensors. Any lock used in a public place is subject to such destructive tampering.

Therefore, in view of the many problems existing in the lock industry, it can be seen that there is a need for an electronic lock system wherein the lock part is simple to construct, requires no built in power source, and is relatively tamperproof. The key part of such a desirable system could contain the power source for lock operation and be capable of opening the lock without being inserted in an aperture of the lock.

SUMMARY OF THE INVENTION

The present invention comprises an inductively coupled binary lock system wherein the key transmits a series of binary pulses to the lock. The lock, on receiving a predetermined sequence of pulses, will open the locking bolt.

The key comprises a variable frequency clock or timing device which inputs pulses to a variable pulse width generator. These pulses are output to one side of a logic circuit and to a coded sequence generator. The coded sequence generator comprises an inverter and plurality of division circuits which are switchably connected. Outputs from the coded sequence generator are input to the logic circuit. The output of the logic circuit is amplified and input to an inductor. The inductor is located in the key in such a manner that it may be placed in close proximity to a receiving inductor in the lock.

The lock unit comprises a receiving inductor, diodes connected to the inductor to generate DC power for the lock drive motor circuit, and the lock logic circuit. Signals from the receiving inductor are input to the lock logic circuit. If the preselected sequence of pulses is received, the logic circuitry passes to the lock drive motor causing it to run in one direction opening the lock lugs. However, if the logic circuitry detects a sequence of pulses which is not the preselected sequence, the signals to the lock drive motor cause the motor to run in the other direction keeping the lock closed.

It can be seen that the lock comprises a key which transmits signals and power to the lock. The lock, upon receiving a preselected sequence of pulses opens. However, if the wrong sequence of pulses is received, the lock remains closed.

There is no specific need for an aperture for the primary operation of the lock system, wherein such aperture can be damaged by attempts to defeat the lock. In the preferred embodiment there is no internal power supply in the lock itself so that location of the lock away from a power source is of no concern. The lock is of relatively simple construction and thus many locks can be built for operation by a single key.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a cross-sectional view of the key and the lock interrelated together to operate the locking mechanism.

FIG. 2 is a circuit diagram of a component of the key.

FIG. 3 details pulse configurations at various points in the circuit shown in FIG. 2.

FIG. 4 is a schematic diagram of the electronic circuitry contained within the lock.

FIG. 5 is a diagram of pulses at various points within the circuitry of FIG. 4.

Similar reference characters refer to similar parts throughout the several views of the drawings.

DETAILED DESCRIPTION

The electronic lock system of the present invention is shown in FIG. 1 and generally represented as 10. Key means 12 is shown in operating position with relation to lock means 14.

Key means 12, in FIG. 1 is shown containing power supply means 16, electronics package means 18 and key inductor means 20. Preferably, power supply 16 may comprise a dry cell battery element or other appropriate DC power source. Switch means 40 on key means 12 is used to open or close the lock. The lock means generally indicated as 14 is shown comprising outer casing means 24 and 25. Internal to the casing means 24 and 25 is lock inductor means 22, motor means 26, gear means 28 and cam means 30. Motor means 26, gear means 28, and cam means 30 are connected to casing means 24 and 25 by appropriately configured bracket 27 or applicable connector means.

It should be noted that, in the preferred embodiment, casing means portion 24 should be formed from a material which is essentially non-magnetic. Plastics and certain stainless steels having low magnetic properties are preferable. However, if other materials are used for the casing portion, such material should have a poor electrical conductance in order to minimize eddy current losses.

FIG. 2 is a circuit diagram of the electronics package 18 and inductive coil means 20 incorporated in key means 12. The electronic package includes clock means 32 generating clock pulses to variable pulse width generator means 34. Output from variable pulse width generator means 34 is split, part going to logic means 44 and 46 and part going to inverter means 36. In the present embodiment, logic means 44 and 46 are AND gates, however, any suitable logic means is appropriate. The output from inverter means 36 is input to a first division means 38 and to switch means 40. The first device means 38 in the present embodiment is divided by two circuits. However, any appropriate division means will suffice.

In the preferred embodiment, one output from division means 38, preferably the inverted output, is input to one side of switch means 40. Switch means 40 permits the selection of the output directly from inverter means 36 or the output from division means 38 to be input to a second division means 42. In the preferred embodiment, division means 42 is also a divide by two circuits. However, as set forth above with regard to the first division means, any appropriate division circuitry will suffice.

The outputs from second division means 42, one inverted and one uninverted, are input to logic means 44 and 46. The outputs from logic means 44 and 46 are input to amplifier means 48. In the preferred embodiment, amplifier means 48 comprises a two transistor amplifier, amplifying the signal from logic means 44 and 46 and inputting the signal to the coil means 20. Power to drive the transistors and the logic in electronics package 18 is derived from power source means 16. It can be seen from FIG. 2 that switch means 40 allows the selection of one or both of the division means 38 and 42.

The circuitry for lock means 14 is shown generally in FIG. 4. Inductive coil means 22 receives the signals as transmitted by key means 12. Capacitor means 60 is inserted to provide sufficient resonance to coil 22 while at the same time smoothing the transmitted signals. The signals received by inductor coil means 22 are input to first and second diode means 62 and 64 to generate a DC supply and fed through conductor means 71 to power amplifier circuit means 86 and 88. The signals from inductor means 22 are also input to third and fourth diode means 66 and 68 and thence input through RC filter 69 into conductor means 70 where the DC power is used to supply the logic circuitry of the lock means.

Finally, signals received by inductor means 22 are input into the logic circuitry of lock means 14. The input from one side of coil means 22 is fed to flip flop means 72, and the signal from the other side of coil means 22 is fed to flip flop means 74. The output from flip flop means 72 is input to flip flop means 74 and the output from flip flop means 74 is input to fifth diode means 76. The output from fifth diode means 76 is input to detector means 78, herein comprising the diode capacitor and resistor. The output from detector means 78 is input to inverter means 80. The output from inverter means 80 is input to amplifier circuit means 86 and to inverter means 82. The output from inverter means 82 is input to amplifier circuitry means 88. Amplifier circuitry means 86 and 88 are, in the preferred embodiment, transistorized amplifiers. The output from amplifier circuitry means 86 and 88 is connected to motor means 26.

FIGS. 3 and 5 depict pulse structure at various points within the circuitry of key means 12 and lock means 15, respectively. The pulses shown in FIG. 3(*a*) are the output of variable pulse width generator means 34. The pulses shown in FIG. 3(*b*) are the output of inverter means 36. It is seen that the pulses as shown in FIG. 3(*a*) are input to one side of both AND gate means 44 and 46. The inverted signals shown in FIG. 3(*b*) are input to switch means 40 and division circuitry means 38. FIGS. 3(*c*) and 3(*d*) are the pulse structure of the output of division means 42 with switch means 40 positioned to by-pass division means 38. FIGS. 3(*e*) and 3(*f*) detail the output of AND gates 44 and 46 with switch means 40 in the position as described above. When switch means 40 is positioned such that the output of division means 38 is input to division means 42, the output pulses from division means 42 are shown in FIGS. 3(*g*) and 3(*h*). The output from AND gate means 44 and 46 with switch means 40 positioned such that the output from division means 38 is input to division means 42, are shown in FIGS. 3(*i*) and (*j*). These pulses are amplified by amplifier means 48 and input to transmitter coil means 20.

FIG. 5 details various pulse configurations at specific points in the lock circuitry. FIG. 5(*a*) are the pulses received at position counter-inputs of flip flop means 72 and 74 when switch means 40 is positioned such as to transmit the signal as shown in FIG. 3(*e*). With switch 40 in this position, the pulse received at the reset input of flip flop means 72 and 74 is shown in FIG. 5(*b*). FIG. 5(*c*) shows the pulse output from flip flop means 72 which is input to flip flop means 74 when switch means 40 is in the position as detailed above. FIGS. 5(*d*) and 5(*e*) show the output from flip flop means 74 and detector means 78 when switch means 40 is positioned to by-pass division means 38. When switch means 40 is positioned such that the output from division means 38 is input to division means 42 the pulse input to the counter input of flip flop means 72 and 74 is detailed in FIG. 5(*f*). The reset pulses input to flip flop means 72 and flip flop means 74 is shown in FIG. 5(*g*). It is thus seen that the counter increments an additional count in this position of switch 40. FIGS. 5(*h*) and 5(*i*) show the inputs of flip flop means 72 and 74 respectively when switch means 40 is positioned to couple the division circuits. FIG. 5(*j*) shows the output of detector circuit means 78.

It can thus be seen that when key means 12 is positioned in communication with lock means 14 a signal is transmitted from key means 12 to lock means 14. When switch means 40 is positioned to by-pass first division means 38 the pulse configuration received by lock means 14 powers motor means 26 and the logic circuitry. The logic circuitry detects the pulses and causes motor means 26 to turn in one direction. When motor means 26 is rotating in this direction the lock remains closed. However, when switch means 40 is set such that first division means 38 is included in the transmitter circuitry, the pulses received by lock means 14 again power the motor and the logic circuitry. But in this case, the logic circuitry generates a signal which causes motor means 26 to rotate in the opposite direction from the previous case. When motor means 26 is rotating in this direction, the lock is caused to open. It will be noted that the lock will only open when the preselected characteristic double pulse, as shown in FIGS. 3(*i*) and 3(*j*), are received by the lock.

It will thus be seen that the objects set forth above, among those made apparent from the preceding description, are efficiently attained and, since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features herein described, and all statements of the scope of the invention which, as a matter of language might be said to fall therebetween.

Now that the invention has been described, what is claimed is:

1. An electronic lock system comprising, in combination: key means including generating means for generating a plurality of electrical signals, first inductor means electrically connected to said generating means; lock means including second inductor means positioned to inductively couple with said first inductor means when said key means is in predetermined spatial relation to said lock means, signal distinguishing means electrically connected in circuit of said lock means and disposed to receive signals from said generating means, whereby a predetermined electrical signal is distinguished from said plurality of electrical signals from said generating means, motor means electrically connected in driven relation to said signal distinguishing means, lock lug means connected in movable, driven relation to said motor means, whereby activation of said motor means causes movement of said lock lug means between a locked and unlocked position.

2. A key means as in claim 1 wherein said generating means further comprises pulse generator means and pulse width adjust means in electrical communication with said pulse generator means, a plurality of gate means each having one input thereof electrically connected to the output of said pulse width adjust means, first inverter means in electrical communication with the output of said pulse width adjust means, first divide means electrically connected to the output of said inverter means, switch means electrically connected to the output of said first inverter means and an output of said first divide means, second divide means electrically connected to said switch means, whereby the input to said second divide means is selectively connectable to either the output of said first inverter means and an output of said first divide means, said second divide means comprising a plurality of outputs electrically connected to the input to said plurality of gate means, first amplifier means electrically connected to outputs of said plurality of gate means and electrically connected to said first inductor means and electrical power source in electrical communication with said first amplifier means.

3. A lock means as in claim 1 wherein said signal distinguishing means further comprises capacitor means across said second inductor means, first, second, third and fourth diode means connected to said second inductor means, first and second flip-flop means, the counter input of which is electrically connected to one side of said second inductor means, the remainder of said inputs of said first and second flip-flops electrically connected to the other side of said second indicator means, one output of said first flip-flop means electrically connected to one input of said second flip flop means, fifth diode means in electrical communication with the output of said second flip-flop means, detector means electrically connected with the output of said fifth diode means, second inverter means electrically connected to the output of said detector means, second amplifier means in electrical communication with output of said second inverter means, third inverter means in electrical communication with the output of said second inverter means, third amplifier means eletrically connected to the output of said third inverter means.

* * * * *

UNITED STATES PATENT AND TRADEMARK OFFICE

CERTIFICATE OF CORRECTION

PATENT NO. : 3,979,647

DATED : September 7, 1976

INVENTOR(S) : Robert Richard Perron, John Thomas Fowler

It is certified that error appears in the above-identified patent and that said Letters Patent are hereby corrected as shown below:

Column 4, line 30 - "15" should read --14--.

Signed and Sealed this

Seventh Day of December 1976

[SEAL]

*Attest:*

RUTH C. MASON
*Attesting Officer*

C. MARSHALL DANN
*Commissioner of Patents and Trademarks*